US006242147B1

(12) United States Patent
Anno et al.

(10) Patent No.: US 6,242,147 B1
(45) **Date of Patent: *Jun. 5, 2001**

(54) NEGATIVELY CHARGEABLE TONER AND DEVELOPING DEVICE USING THEREOF

(75) Inventors: Masahiro Anno, Sakai; Hiroyuki Fukuda, Sanda, both of (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/146,258

(22) Filed: Sep. 3, 1998

(30) Foreign Application Priority Data

Sep. 3, 1997 (JP) ..... 9-238550
Sep. 3, 1997 (JP) ..... 9-238561

(51) Int. Cl.[7] ..... G03G 9/097

(52) U.S. Cl. ..... 430/110; 430/122; 399/274; 399/252

(58) Field of Search ..... 430/110, 122; 399/267, 274, 252

(56) References Cited

U.S. PATENT DOCUMENTS

| | | | | |
|---|---|---|---|---|
| 4,640,882 | | 2/1987 | Mitsuhashi et al. | 430/110 |
| 4,767,688 | | 8/1988 | Hashimoto et al. | 430/110 |
| 4,828,954 | | 5/1989 | Hashimoto et al. | 430/110 |
| 4,973,540 | * | 11/1990 | Machida et al. | 430/110 |
| 5,021,317 | | 6/1991 | Matsubara et al. | 430/110 |
| 5,024,915 | | 6/1991 | Sato et al. | 430/110 |
| 5,049,467 | | 9/1991 | Yamanaka | 430/110 |
| 5,176,979 | | 1/1993 | Eguchi et al. | 430/110 |
| 5,350,657 | * | 9/1994 | Anno et al. | 430/110 |
| 5,665,511 | * | 9/1997 | Imai et al. | 430/110 |
| 5,707,770 | * | 1/1998 | Tanikawa et al. | 430/110 |
| 5,714,292 | | 2/1998 | Anno et al. | 430/110 |
| 5,827,632 | * | 10/1998 | Inaba et al. | 430/110 |
| 5,863,692 | * | 1/1999 | Nakamura et al. | 430/110 |

FOREIGN PATENT DOCUMENTS

| | | |
|---|---|---|
| 3-112990 | 5/1991 | (JP) . |
| 4-340558 | 11/1992 | (JP) . |
| 8-194330 | 7/1996 | (JP) . |

* cited by examiner

*Primary Examiner*—Christopher Rodee
(74) *Attorney, Agent, or Firm*—Burns, Doane, Swecker & Mathis, LLP

(57) ABSTRACT

The present invention relates to a negatively chargeable toner comprising fine toner particles which contain a thermoplastic resin, a colorant, and a specified compound; the toner externally admixed with inorganic fine particles which have been treated with a hydrophobicizer and a silane coupling agent having a cationic group and/or a silicone oil having a cationic group, and which have a blow-off charge quantity (Q) of $-800<Q<0$ $\mu$C/g relative to iron oxide particles.

31 Claims, 2 Drawing Sheets

NEGATIVELY CHARGEABLE TONER AND DEVELOPING DEVICE USING THEREOF

This application is based on application Ser. No. Hei 9-238550 and Hei 9-238561 filed in Japan, the contents of which are hereby incorporated by reference.

BACKGROUND OF THE INVENTION

1. Field of the Invention

The present invention relates to a full-color imaging toner for use in a full-color image forming apparatus, such as full-color copying machine and full-color printer.

2. Description of the Related Art

Various kinds of image forming apparatuses, such as copying machine, printer, and facsimile, have been widely used such that an electrostatic latent image formed on a photosensitive member is developed with a toner into a toner image which in turn is transferred on a recording medium, such as recording paper, for image formation. Recently, full-color image forming apparatuses, such as full-color copying machine and full-color printer, have been increasingly used in reproducing a full color image using a plurality of color toners.

Such full-color image forming apparatuses of various systems have been known in the art. For example, in one known system, an electrostatic latent image corresponding to a predetermined color is formed on a charged photosensitive member by a writing means or the like which irradiates a light beam, such as laser beam, and a predetermined toner selected from magenta, cyan, and yellow toners and, when required, black toner, is supplied to the electrostatic latent image for development thereof. The resulting toner image transferred onto a recording medium, such as recording paper, held on an intermediate transfer member. The steps of forming such a latent image, developing the latent image into a toner image, and transferring the toner image are carried out for each respective color to form a full-color toner image such that toner images of respective colors are placed in superposed relation on the recording paper, the toner image being then fixed on there recording paper. In another known system, a predetermined toner selected from magenta, cyan, and yellow toners and, when required, black toner, is supplied to an electrostatic latent image corresponding to a predetermined color which is formed on the photosensitive member for development as above described, and the resulting toner image is transferred onto an intermediate transfer member. The steps of forming such a latent image, developing the latent image into a toner image, and transferring the toner image are carried out for each respective color to form a full-color toner image such that toner images of respective colors are placed in superposed relation on the intermediate transfer member. Thereafter, the full-color toner image is transferred from the intermediate transfer member to a recording medium so that the toner image is fixed on the recording paper.

For transfer of a toner image formed on the photosensitive member or the like to a recording medium, there has been known a transfer device such that, as described in Japanese Patent Application Laid-Open No. Sho59-46664, a bias voltage-applied roller is brought into pressure engagement with a photosensitive member to form a nip between the transfer roller and the photosensitive member through which a recording sheet is caused to pass so that the toner image on the photosensitive member is press-transferred onto the recording sheet. Use of such a transfer device makes it possible to reduce out-of-sync possibility of recording-paper transport and transfer deviation and, in addition, to reduce the length of the transport path for recording paper and the size of the photosensitive member to thereby achieve the size reduction of the image forming apparatus.

However, the use of the transfer device poses a problem that since the transfer roller is held in pressure engagement with the photosensitive member on which a toner image has been formed, the toner is forcibly pressed against the photosensitive member into adhesion thereto, so that the toner at a center portion of the toner image is not satisfactorily transferred onto the recording paper. This may often result in an image defect such that a so-called image break trouble occurs with respect to the image formed.

In case that such a transfer device is used in such a full-color image forming apparatus as described above, an image break due to such erroneous transfer as aforesaid tends to occur because of the fact that, as above stated, magenta, cyan, yellow toners and, when required, black toner are respectively transferred so that toner images of respective colors are placed in superposed relation. More especially where, after toner images of respective colors are press-transferred onto the intermediate transfer member, the transferred toner image on the intermediate transfer member is further press-transferred onto recording paper, an image break trouble is prone to occur in the course of toner image transfer from the intermediate transfer member to the recording paper, so that the image obtained has quite a number of image breaks.

Generally, in full-color image forming methods, wherein toner requirements are so high that toner supply must be replenished so often, quick rise is required to a predetermined charge level of each additional toner supply.

In the event that the toner charge should fall short of the requirement, or that the toner should be so excessively charged as to cause variations in toner charge, any smooth and uniform transfer of the toner image to the intermediate transfer member or the like could not be achieved, with the result that there would occur fogging and toner dusting which would, in turn, lead to image quality degradation.

Where the toner is triboelectrically charged in relation to a carrier or a charging member (a blade or sleeve), it is desirable that after the toner has been charged to a specified charge level, the charge should be kept constant. If the charge continues to increase after a charge rise to the predetermined charge level, the charge becomes larger than required. The presence of such a toner may cause toner particles to electrostatically adhere to the carrier and charging member to form an accumulation of toner particles. As a result, the chargeability of the carrier and charging member relative to the toner is lowered to cause variations in toner charge, and this will inevitably lead to the occurrence of aforesaid troubles, such as fogging and dusting. Therefore, it is required that once the toner is charged to a specified level, the toner charge must be kept stable at the specified level.

The above mentioned problem is more pronounced in a full-color image forming method for solid image formation in particular wherein the toner is used in an increased concentration relative to the carrier.

Further, in view of the fact that the toner charge is subject to variations depending upon the environmental conditions in which the toner is placed, it is required that the toner is environmentally stable.

SUMMARY OF THE INVENTION

The present invention is to provide a negatively chargeable toner suitable for use in forming full-color images which has good toner charge rise capability, constant charge retentivity and high environmental stability.

The present invention relates a negatively chargeable toner comprising fine toner particles which contain a thermoplastic resin, a colorant, and a compound selected from the group consisting of the following general formulas (I), (II) and (III); the toner externally admixed with inorganic fine particles which have been treated with a hydrophobicizer and a silane coupling agent having a cationic group and/or a silicone oil having a cationic group, and which have a blow-off charge (Q) of $-800<Q<0$ $\mu$C/g relative to iron oxide particles;

(I)

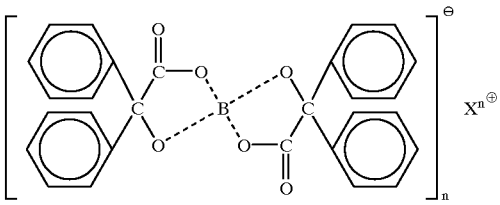

(II)

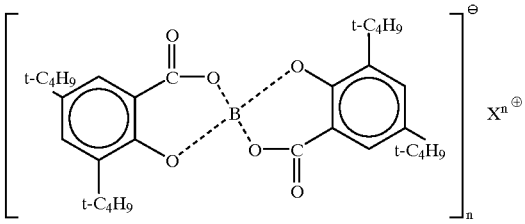

(III)

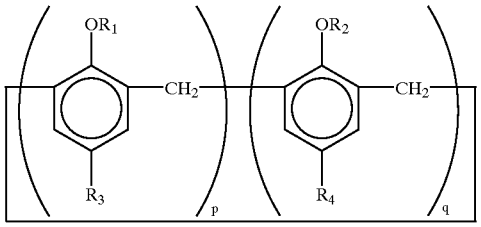

in which X represents cation, and n represents an integer of 1 or 2, $R_1$ and $R_2$ respectively represent a hydrogen atom and an alkyl group having 1 to 5 carbon atoms or —$(CH_2)_xCOOR^5$ group ($R_5$ represents a hydrogen atom or a lower alkyl group; x represents an integer of 1–3); $R_3$ and $R_4$ each represent a hydrogen atom, a halogen atom, an alkyl group having 1 to 12 carbon atoms which may be branched or aryl group; p represents an integer of 4 to 8; q represents an integer of 0 to 4; and p+q is 4 to 8.

DETAILED DESCRIPTION OF THE INVENTION

Figure 1:
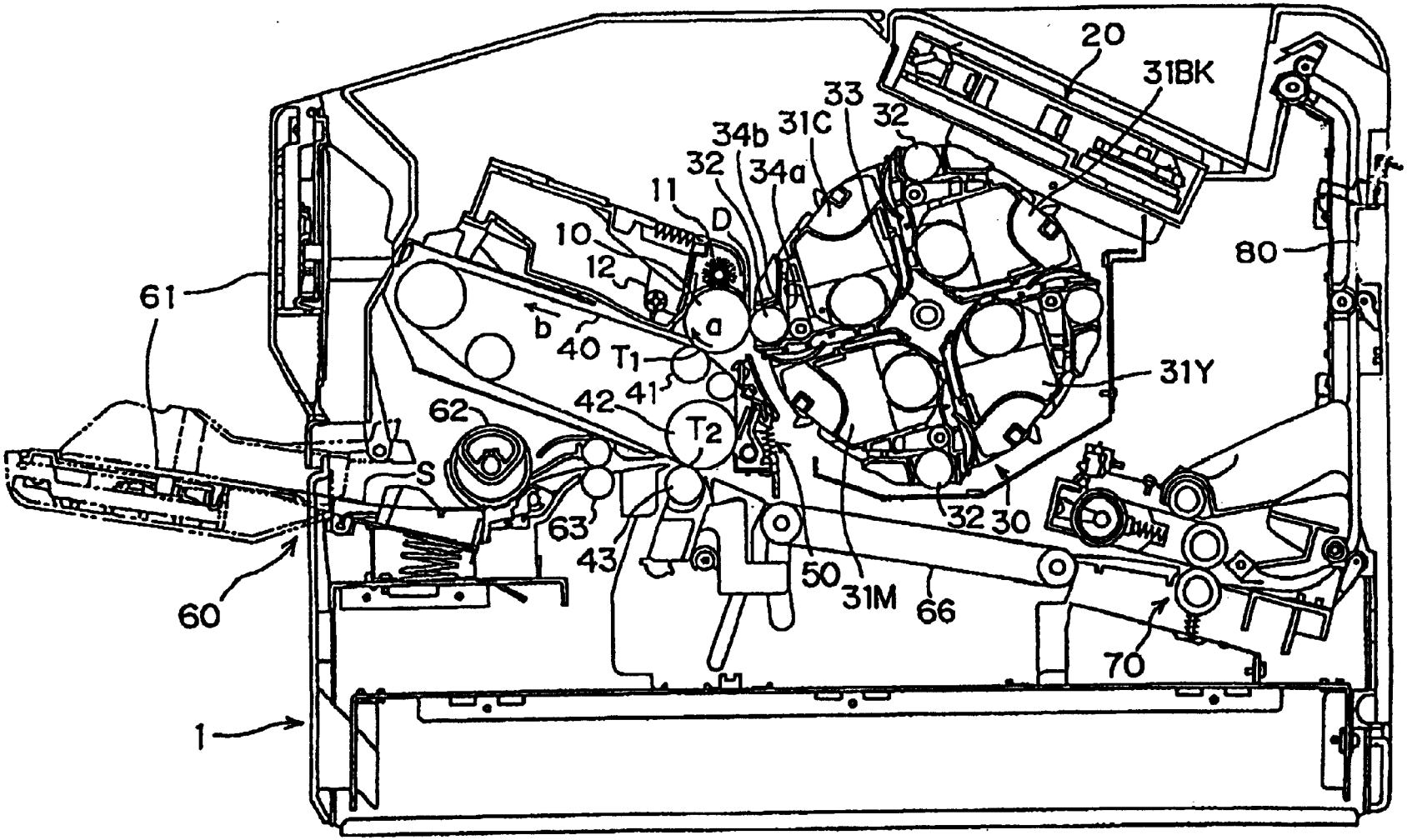
FIG. 1 is a schematic view showing the arrangement of a mono-component full-color image-forming apparatus.

The present invention, in one aspect thereof, provides a negatively chargeable toner comprising fine toner particles which contain a thermoplastic resin, a colorant, and at least one compound expressed by the following general formulas (I) and (II):

(I)

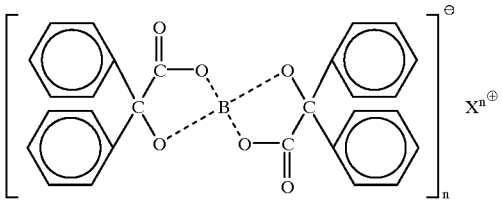

(II)

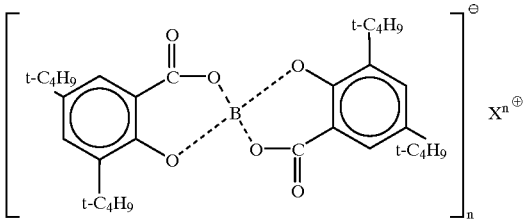

in which, X represents cation, and n represents an integer of 1 or 2, the toner externally admixed with inorganic fine particles which have been treated with a hydrophobicizer and a silane coupling agent having a cationic group and/or a silicone oil having a cationic group, and which have a blow-off charge (Q) of $-800<Q<0$ $\mu$C/g relative to iron oxide particles.

The present invention, in another aspect thereof, provides a negatively chargeable toner comprising fine toner particles which contain a thermoplastic resin, a colorant, and a calix arene compound expressed by the following general formula:

(III)

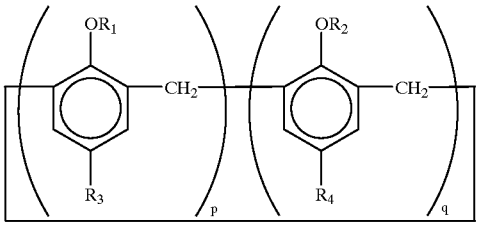

(in which, $R_1$ and $R_2$ respectively represent a hydrogen atom and an alkyl group having 1 to 5 carbon atoms or —$(CH_2)_xCOOR_5$ group ($R_5$ represents a hydrogen atom or a lower alkyl group; x represents an integer of 1–3); $R_3$ and $R_4$ each represent a hydrogen atom, a halogen atom, an alkyl group having 1 to 12 carbon atoms which may be branched or aryl group; p represents an integer of 4 to 8; q represents an integer of 0 to 4; and p+q is 4 to 8), the fine toner particles being externally added with inorganic fine particles which have been treated with a hydrophobicizer and a silane coupling agent having a cationic group and/or a silicone oil having a cationic group, the inorganic fine particles having a contact blow-off charge (Q) of $-800<Q<0$ $\mu$C/g relative to iron oxide particles.

For inorganic fine particles usable in the present invention, silica, titanium dioxide, alumina, zinc oxide, strontium titanate, and calcium titanate are exemplified. Such fine particles as have a mean primary particle size range of from 0.001 to 5 μm, preferably from 0.01 to 1 μm are preferably used.

More specifically, as such silica fine particles the following are commercially available: those produced by a dry process including AEROSIL 50, AEROSIL 90G, AEROSIL 130, AEROSIL 200, AEROSIL 300, AEROSIL 380, AEROSIL TT600, AEROSIL MOX170, AEROSIL MOX80, and AEROSIL COK84 (all made by Nihon Aerosil K. K.); Ca—O-SiL L-90, Ca—O-SiL LM-130, Ca—O-SiL LM-150, Ca—O-SiL M-5, Ca—O-SiL PTG, Ca—O-SiL MS-55, Ca—O-SiL H5, Ca—O-SiL HS5, and Ca—O-SiL EH-5 (all made by CABOT K.K.); WACKER HDK, WACKER N20, WACKER U15, WACKERN20E, WACKER T30, and WACKER T40 (all made by WACKER-CHEMIE GMBH); D-C Fine Silica (made by Dow Corning K.K.); Fransol (made by Fransil K.K.); and Admafine SO-E2, Admafine SO-E3, Admafine SO-C2, Admafine SO-C3, and Admafine SO-C5 (all made by Admatechs K.K.); and those produced by a wet process including Carplex #67, Carplex #80, Carplex #100, Carplex #1120, FPS-1, FPS-3, and FPS-4 (all made by Shionogi Seiyaku K. K.); and Seehoster (made by Nihon Shokubai K. K.).

Titanium dioxide fine particles usable in the invention are commercially available in various types, including anatase-type titanium dioxide particles, such as KA-10, KA-15, KA-20, KA-30, KA-35, KA-80, KA-90, and STT-30 (all made by Chitan Kogyo K. K.); rutile-type titanium dioxide particles, such as KR-310, KR-380, KR-460, KR-480, KR-270, and KV-300 (all made by Chitan Kogyo K. K.); titanium dioxide particles made by Teika K.K. which are available on the market under the trade names of MT-150A, MT-600B, MT-100S, MT-500B, JR-602S, and JR-600A; and titanium dioxide particles made by Nihon Aerosil K. K. which are available on the market under the trade name of P25.

Alumina fine particles usable in the invention are commercially available under the following trade names: Aluminium Oxide C (made by Nihon Aerosil K. K.); and Admafine AO-500, Admafine AO-502, Admafine AO-509, Admafine AO-800, Admafine AO-802, and Admafine AO-809 (all made by Admatechs K.K.).

Zinc oxide fine particles usable in the invention are commercially available under the following trade names: ZINCOX SUPER, ZINCOX SUPER-10, ZINCOX SUPER-20R, ZINCOX SUPER-30, 23-K, 23-K(A), and 23-K(C) (all made by Hakusui Kagaku Kogyo K. K.).

Strontium titanate fine particles usable in the invention are commercially available, including those sold under the trade name of ST (made by Fuji Chitan Kogyo K. K.).

Calcium titanate fine particles usable in the invention are commercially available, including those sold under the trade name of CT (made by Fuji Chitan Kogyo K. K.).

In the present invention, such inorganic fine particles as mentioned above are treated with a hydrophobicizing agent and a silane coupling agent having a cationic group and/or a silicone oil having a cationic group.

For use as a hydrophobicizing agent in the above connection the following may be enumerated: silane coupling agents, such as chlorosilane, alkylsilane, alkoxysilane, and silazane, and silicone oil.

More specifically, the following may be given as examples of silane coupling agents:

$CH_3SiCl_3$ $(CH_3)_2SiCl_2$ $(CH_3)_3SiCl$ $CH_3Si(OCH_3)_3$ $CH_3Si(OCH_2CH_3)_3$ $(CH_3)_3Si(OCH_3)$ $(CH_3)_2Si(OCH_3)_2$ $(CH_3)_2Si(OCH_2CH_3)_2$ $Si(OCH_2CH_3)_4$ $Si(OCH_3)_4$ $CH_3(H)Si(OCH_3)_2$ $CH_3(H)Si(OCH_2CH_3)_2$ $(CH_3)_2(H)Si(OCH_2CH_3)$

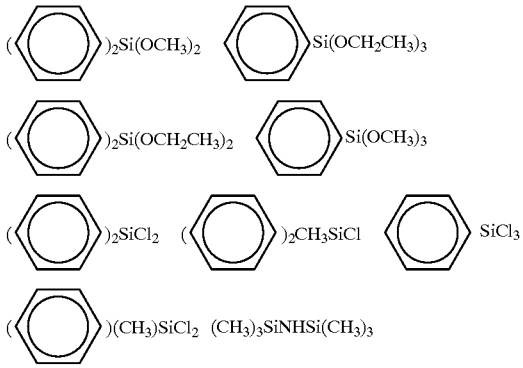

$CH_3(CH_2)_{17}Si(CH_3)(OCH_3)_2$ $CH_3(CH_2)_{17}Si(OCH_3)_3$ $CH_3(CH_2)_{17}Si(OC_2H_5)_3$ $CH_3(CH_2)_3Si(CH_3)_2Cl$ $CH_3(CH_2)_{17}Si(CH_3)Cl$ $CH_3(CH_2)_{17}Si(CH_3)Cl_2$ $CH_3(CH_2)_{17}SiCl_3$

For the silicone oil, silicone oils having a viscosity of 0.5 to 10,000 centistoke, preferably 1 to 1,000 centistoke, at 25° C. are preferably used including, for example, dimethyl silicone oil, methyl phenyl silicone oil, α-methylstyrene modified silicone oil, chlorophenyl silicone oil, and fluorine-modified silicone oil.

The quantity of the hydrophobicizing agent to be used in the present invention is within the range of from 1 to 50 parts by weight, preferably from 5 to 30 parts by weight, relative to 100 parts by weight of inorganic fine particles.

For the treating agent having a cationic group, amino silane, an ammonium salt group-containing silane, and an amino-modified silicone oil may be used.

The amino silane is a so-called amino functional silane, and any amino silane expressed by the following general formula may be used as such:

$$X^0_{m1}SiY_{n1}$$

(in which, $X^0$ denotes an alkoxy group or chlorine atom; $m_1$ denotes an integer of 1–3; Y denotes a hydrocarbon group having a primary, secondary or tertiary amino group; and $n_1$ denotes an integer of 1–3).

Specifically,

1)

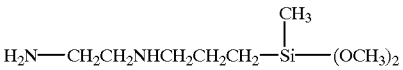

2)

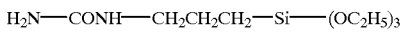

3)

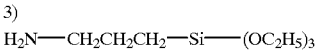

4)

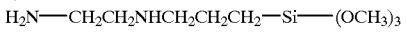

-continued

5)

$H_2N—CH_2CH_2CH_2—Si—(OCH_3)_3$

6)

$H_2N—CH_2CH_2NHCH_2CH_2NHCH_2CH_2CH_2—Si—(OCH_3)_3$

7)

$H_5C_2OCOCH_2CH_2NHCH_2CH_2CH_2—Si—(OCH_3)_3$

8)

$H_5C_2OCOCH_2CH_2NHCH_2CH_2NHCH_2CH_2CH_2—Si—(OCH_3)_3$

9)

$H_5C_2OCOCH_2CH_2NHCH_2CH_2NHCH_2CH_2NHCH_2CH_2—NHCH_2CH_2CH_2—Si—(OCH_3)_3$

10)

$NH_2C_6H_4—Si—(OCH_3)_3$

11)

$C_6H_5NHCH_2CH_2CH_2—Si—(OCH_3)_3$

12)

poly (aminoalkyltrialkoxysilane)

13)

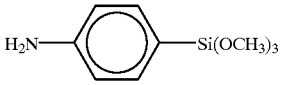

14)

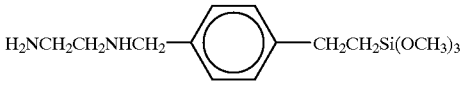

15)

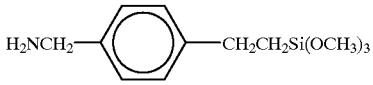

16)

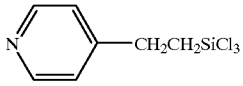

17)

$H_2NCH_2Si(OCH_3)_3$

18)

$H_2NCH_2CH_2Si(OC_2H_5)_3$

19)

$H_2NCH_2CH_2CH_2Si(CH_3)(OC_2H_5)_2$

20)

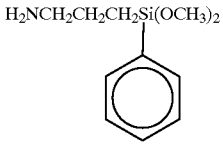

21)

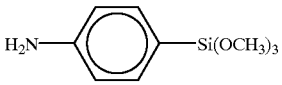

22)

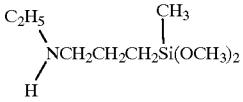

23)

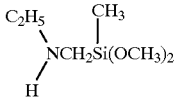

24)

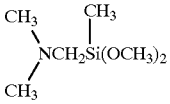

25)

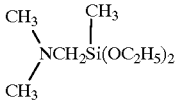

26)

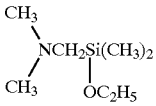

27)

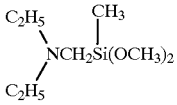

28)

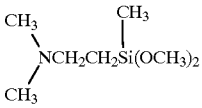

29)

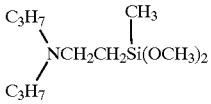

30)

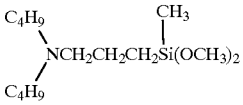

31)

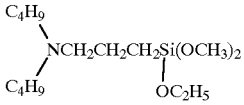

32)

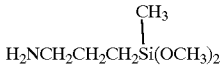

33)

$H_3COCOCH_2CH_2NHCH_2CH_2CH_2Si(OCH_3)_3$

34)

$H_5C_2OCOCH_2CH_2NHCH_2CH_2NHCH_2CH_2NHCH_2CH_2$

35)

$H_3COCOCH_2CH_2NHCH_2CH_2NHCH_2CH_2CH_2Si(OCH_3)_3$

-continued

36)

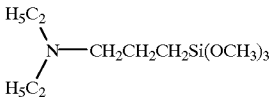

38)

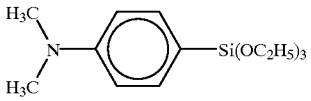

are exemplified.

For the ammonium salt group-containing silane, specifically, (1)

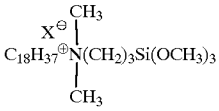

(2)

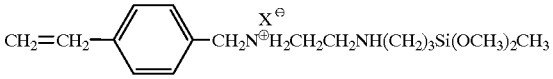

(3)

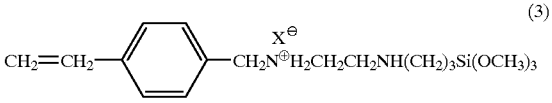

(4)

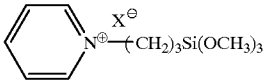

(5)

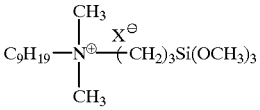

(6)

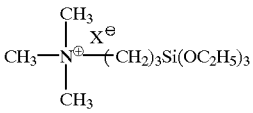

(7)

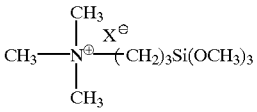

(8)

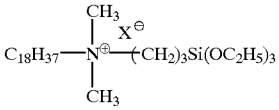

(9)

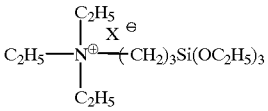

37)

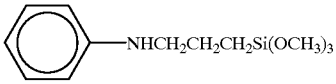

-continued (10)

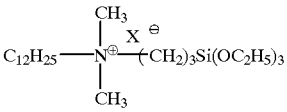

are exemplified.

In addition to the above, those in which the alkoxy group of the organosilane is replaced by other hydrolytic group or hydroxyl group may be enumerated, and two or more kinds of such organosilane may be used in combination.

For the amino-modified silicone oil, those expressed by the following general formula are usable as such:

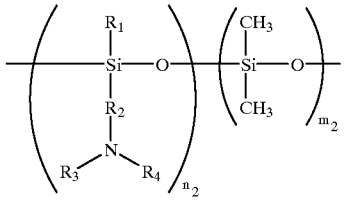

(in which, $R_{10}$ denotes a hydrogen atom, an alkyl group, an aryl group, or an alkoxy group; $R_{12}$ denotes an alkylene group or phenylene group; and $R_{13}$, $R_{14}$ denote a hydrogen atom, an alkyl group or an aryl group; the alkyl group, aryl group, alkylene group, or phenylene group may contain amine or may have a substituent group, such as a halogen atom, unless the chargeability of the toner is thereby adversely affected; and $m_2$ and $n_2$ denotes a positive integer).

Specifically, the following are commercially available.

| Trade name | Viscosity at 25° C. (cPs) | Amine equiv. |
|---|---|---|
| SF8417 (made by Toray-Silicone K.K.) | 1200 | 3500 |
| KF393 (made by Shinetsu Kagaku K.K.) | 60 | 360 |
| KF857 (made by Shinetsu Kagaku K.K.) | 70 | 830 |
| KF860 (made by Shinetsu Kagaku K.K.) | 250 | 7600 |
| KF861 (made by Shinetsu Kagaku K.K.) | 3500 | 2000 |
| KF862 (made by Shinetsu Kagaku K.K.) | 750 | 1900 |
| KF864 (made by Shinetsu Kagaku K.K.) | 1700 | 3800 |
| KF865 (made by Shinetsu Kagaku K.K.) | 90 | 4400 |
| KF369 (made by Shinetsu Kagaku K.K.) | 20 | 320 |
| KF383 (made by Shinetsu Kagaku K.K.) | 20 | 320 |
| X-22-3680 (made by Shinetsu Kagaku K.K.) | 90 | 8800 |
| X-22-380D (made by Shinetsu Kagaku K.K.) | 2300 | 3800 |
| X-22-3801C (made by Shinetsu Kagaku K.K.) | 3500 | 3800 |
| X-22-3810B (made by Shinetsu Kagaku K.K.) | 1300 | 1700 |

The term "amine equivalent (equiv.)" means an equivalent to one amine (g/equiv), that is, the value of the molecular weight divided by the number of amines for one molecule.

The quantity of the treating agent having a cationic group which is to be used in the present invention is 0.1 to 20 parts by weight, preferably 0.5 to 10 parts by weight.

For the purpose of treating inorganic fine particles with such a hydrophobicizing agent and such a surface treating agent having a cationic group as above mentioned, the surface treating agent is diluted by being mixed with a solvent, such as tetrahydrofuran (THF), toluene, ethyl acetate, methyl ethyl ketone, acetone ethanol, or hydrogen chloride saturated ethanol. While the inorganic fine powder is forcibly agitated by a blender or the like, the diluted liquid of the surface treating agent is added dropwise or by spraying to the inorganic fine powder and mixing is thoroughly effected. In this connection, various devices, such as kneader-coater, spray dryer, thermal processor, and fluidized bed, may be employed.

The resulting mixture is transferred into a vat, which is then heated and dried in an oven. Thereafter, the dried mixture is thoroughly disintegrated in a mixer, jet mill or the like. It is desirable that particle classification be carried out as required. It is preferable that the inorganic fine particles treated with the hydrophobicizing agent and with the surface treating agent have a volume-mean particle size (particle size of secondary aggregated particles) of not more than 10 $\mu$m measured according to a laser diffraction dry method and contain not more than 1% by volume of aggregated particles having a particle size of 30 $\mu$m or more. In the foregoing process, respective surface treating agents may be used either simultaneously or separately for treatment.

In addition to above described dry method, there is a wet treating method such that finely divided inorganic powder is immersed in an organic solvent solution of a surface treating agent and then dried, or such that after finely divided inorganic powder is dispersed in water and made into a slurry form, an aqueous solution of a surface treating agent is added dropwise onto the inorganic fine particles which in turn are settled, heated to dry, being then disintegrated. The heating temperature is preferably 100° C. or more. If the temperature is less than 100° C., the condensation reaction of the inorganic fine particles with the surface treating agent can hardly be completed.

In the present invention, it is necessary that finally obtained inorganic fine particles should have a hydrophobicity of 30% or more, preferably 50% or more, and that the inorganic fine particles should have an electrostatic blow-off charge quantity (Q) of $-800<Q<0$ $\mu$C/g, preferably −700 to −200 $\mu$C/g, relative to iron oxide particles.

In the present invention, hydrophobicity is calculated in the following way. Fifty (50) ml of pure water is put in a 200 ml beaker and 0.2 g of silica is added. With the beaker held under stirring, a methanol dehydrated with sodium sulfoanhydride is added until little or no silica is recognized on the liquid surface. Hydrophobicity is calculated from the quantity of methanol required and according to the following equation.

Hydrophobicity (%)=C/(50+C)×100 (in which C denotes quantity of methanol used (ml)).

Measurement of blow-off charge of inorganic fine particles was made by using a blow-off powder charge measuring apparatus (made by Toshiba Chemical K. K.). Measurements are shown in values as obtained when mixing was made in a tumbling mixer for 1 minute with the sample concentration set at 0.2 wt. % relative to the iron oxide powder carrier (Z-150/250, made by Powdertech K.K.) and under conditions of: SUS 400 mesh and blow pressure of 1 kgf/cm$^2$, 60 sec.

The toner to be added with such inorganic fine particles as obtained in the above mentioned way is a toner which comprises at least a binder resin and a colorant and may contain other desired additives, such as anti-offset agent, a charge control agent, and other kinds of resin fine particles. The toner may be applied to a two-component developer, a non-magnetic mono-component developer not containing carrier, or a magnetic mono-component developer.

Preferably, in the present invention, such inorganic fine particles are used as an additive to a toner comprising a styrene-(meth)acrylic copolymer resin, a polyester resin, or epoxy resin as a binder resin and, as a charge control agent, a compound expressed by the following general formulas (I) and (II):

(I)

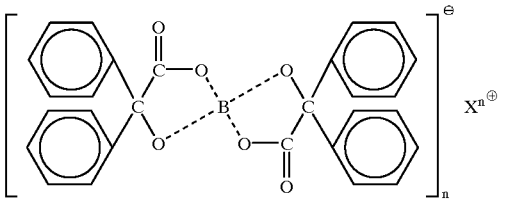

(II)

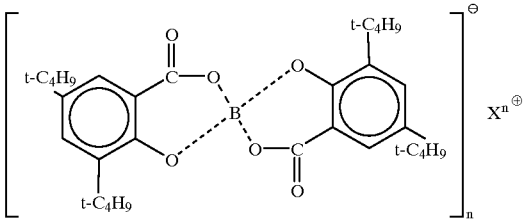

in shich X represents a cation, and n represents an integer of 2. By constituting the toner in this way it is possible to lower any excessive negative charge of the toner more effectively for adjustment to a proper charge level, and also to improve the charge rise characteristic of the toner. Additionally, above mentioned compound(s) has high heat resistance such that the compound is not decomposed during the process of toner production or the thermal fixation process. Furthermore, the compound is a colorless material and can be used for production of a full-color toner without detriment to the light transmission and color reproduction characteristics of the toner.

In the above general formulas (I) and (II), cations represented by X may be exemplified by, for example, alkali metal ions of lithium, sodium, and potassium; hydrogen ions; alkali earth metal ions of magnesium and calcium; ammonium ions; iminium ions; and phosphonium ions. Preferably, X is sodium or potassium. Character n denotes an integer of 1 or 2. Preferably, n is 1.

The quantity of addition of such a compound is in the range of 0.1 to 10 parts by weight, preferably 0.3 to 5.0 parts by weight. If the proportion of the compound is too small, there could be obtained no sufficient effect of the compound to lower the toner charge to a level within a proper toner charge range or to enhance the charge rise performance of the toner. If the proportion of the compound is too large, during a voluminous printing operation, particles of the compound tend to be displaced to the carrier in the case of two-component development, or onto the developer support member and/or developer regulating member in the case of mono-component development, with the result that no proper toner charge could be obtained.

In the present invention, above mentioned inorganic fine particles may be used as an additive to a toner containing a styrene-(meth) acrylic copolymer resin, a polyester resin or epoxy resin as a binder resin and, as a charge control agent, a calix arene compound expressed by the following general formula (III):

(III)

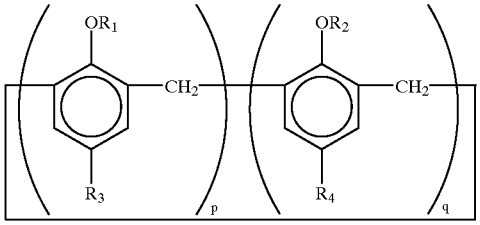

In the above formula, $R_1$ and $R_2$ respectively represent a hydrogen atom and an alkyl group having 1 to 5 carbon atoms or —$(CH_2)xCOOR_5$ group ($R_5$ represents a hydrogen atom or a lower alkyl group, such as methyl or ethyl; x represents an integer of 1–3).

$R_3$ and $R_4$ each represent a hydrogen atom, a halogen atom, such as a chlorine atom and a bromine atom, an alkyl group having 1 to 12 carbon atoms which may be branched or aryl group, such as a phenyl group.

Character p represents an integer of 4 to 8; q represents an integer of 0 to 4; and p+q is 4 to 8.

By constituting the toner in this way it is possible to lower any excessive negative charge of the toner more effectively for adjustment to a proper charge level, and also to improve the charge rise characteristic of the toner. Additionally, above mentioned compound has high heat resistance such that the compound is not decomposed during the process of toner production or the thermal fixation process. Furthermore, the compound is a colorless material and can be applied to a full-color toner without detriment to the light transmission and color reproduction characteristics of the toner.

In the above given general formula (III), preferred compounds are compounds expressed by the following general formula (IV):

(IV)

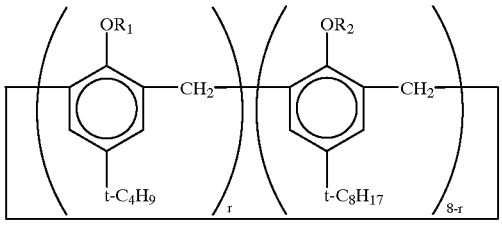

in which $R_1$ and $R_2$ each have the same meaning as that in formula (III); and r denotes an integer of 1 to 7, or a mixture of two or more kinds of compounds expressed by the general formula (IV) but having different numbers for r, where $R_1$ and $R_2$ each have the same meaning as that in formula (III) and r denotes an integer of 0 to 8.

Specifically, examples of calix arene compounds expressed by general formula (III) are enumerated below. It is to be understood, however, that the examples shown are only illustrative and not restrictive.

(1)

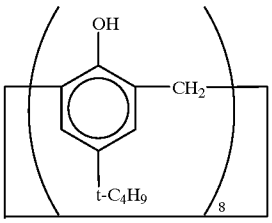

(2)

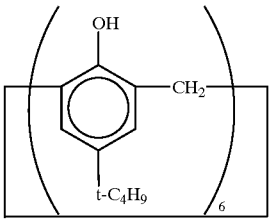

(3)

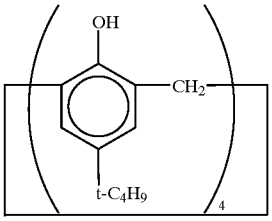

(4)

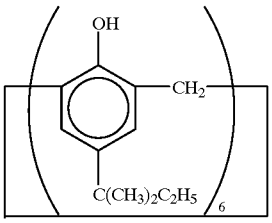

(5)

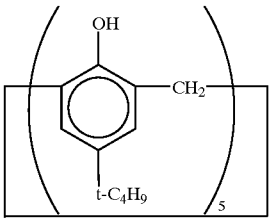

(6)

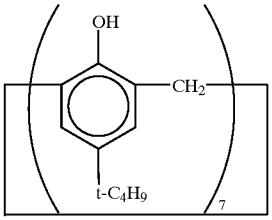

-continued
(7)
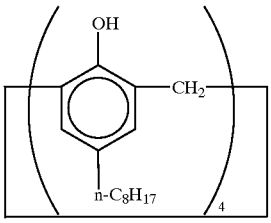
(8)
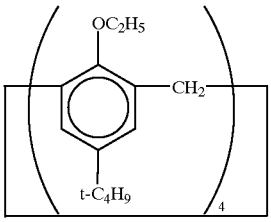
(9)
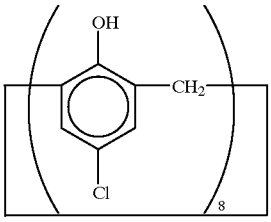
(10)
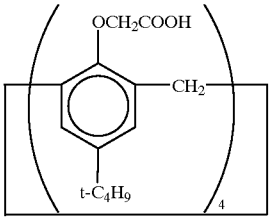
(11)
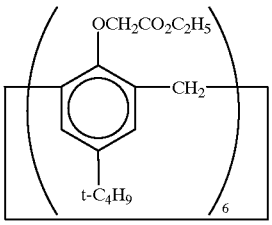
(12)
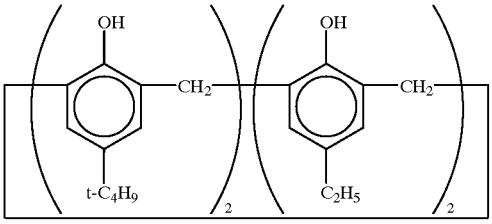
-continued
(13)
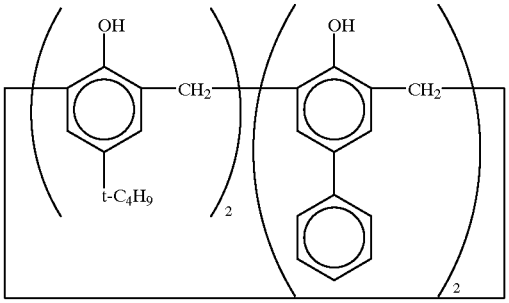
(14)
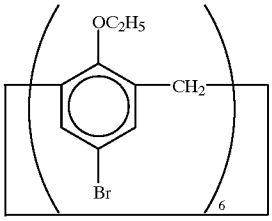
(15)
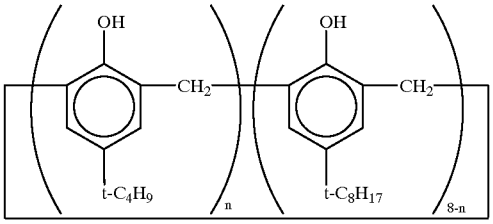
(n = 1~7)
(16)
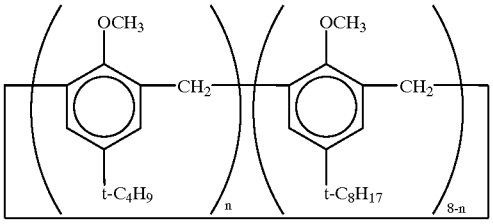
(n = 1~7)
(17)
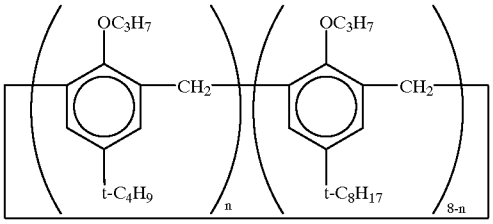
(n = 1~7)

-continued (18)

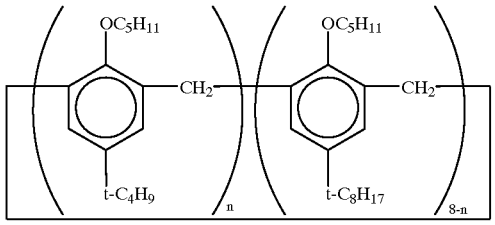

(n = 1~7)

(19)

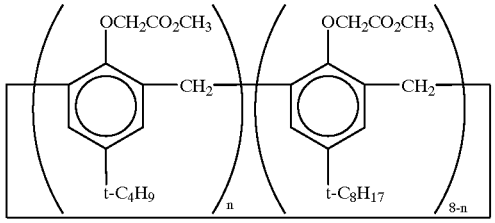

(n = 1~7)

The quantity of addition of a calix arene compound expressed by general formula (III) is preferably in the range of 0.1 to 10 parts by weight, more preferably 0.3 to 5.0 parts by weight. If the proportion of the compound is too small, there could be obtained no sufficient effect of the compound to lower the toner charge to a level within a proper toner charge range or to enhance the charge rise performance of the toner. If the proportion of the compound is too large, during a voluminous printing operation, particles of the compound tend to be displaced to the carrier in the case of two-component development, or onto the developer support member and/or developer regulating member in the case of mono-component development, with the result that no proper toner charge could be obtained.

Toners may be produced by any known method, for example, a pulverizing method, a wet method, such as suspension polymerization/suspension granulation method, a microcapsule method, a spray dry method, or a mechanochemical method. The toner is produced so that the toner has a volume mean particle size of 2 to 10 $\mu$m, preferably 5 to 9 $\mu$m. Toners which can be advantageously used in the present invention include not more than 2% by weight of particles having not less than two times (2D) the volume mean particle size (D), and not more than 5% by number of particles having a particle size of not more than one third (D/3) of the volume mean particle size. Toner particle size values given show measurements obtained by using a Coulter Multisizer (made by Coulter Counter K.K), with aperture diameter set at 50 $\mu$m.

The inorganic fine particles are added to such a toner within a quantity range of 0.01 to 10 parts by weight, preferably 0.1 to 5, preferably 0.1 to 5 parts by weight, relative to 100 parts by weight of the toner.

The following examples are given to further illustrate the present invention.

Figure 2:
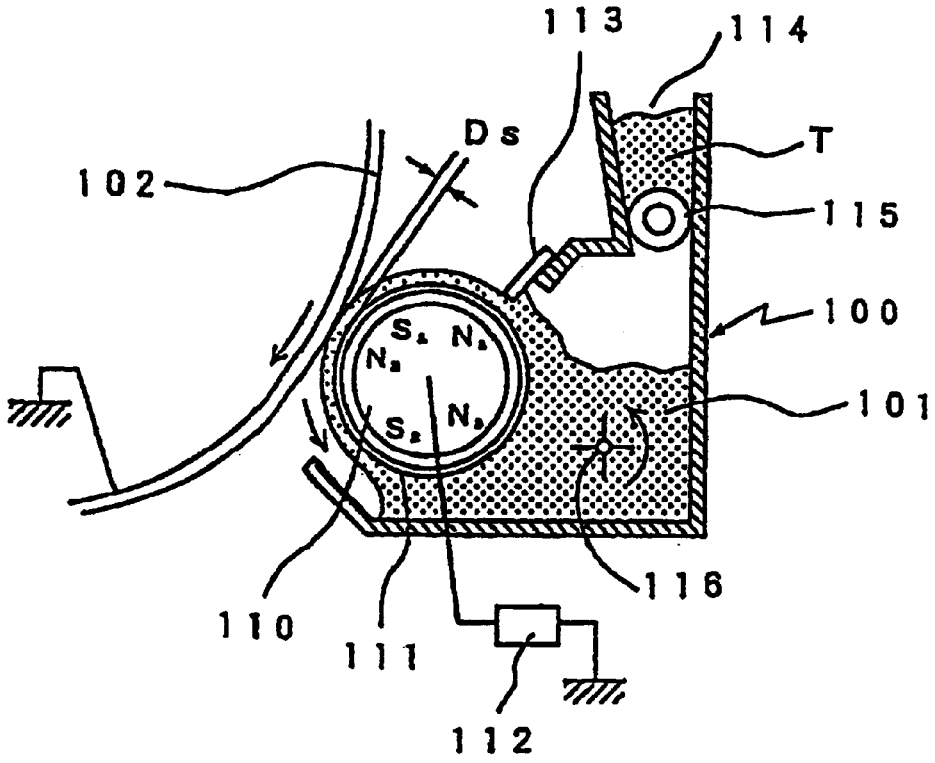
FIG. 2 is a schematic view showing the arrangement of a two-component developing device.

In the following examples, evaluation of toners was carried out by applying the toners for use in such developing apparatuses as shown in FIGS. 1 and 2. First, therefore, explanation will be given with respect to the apparatuses.

The full-color image forming apparatus shown in FIG. 1 is a mono-component developing apparatus including a rotatably driven photosensitive drum 10, there being provided around the photosensitive drum 10 a charging brush 11 for charging the surface of the drum 10 to a specified potential, and a cleaner 12 for removing any toner residue present on the drum 10.

A laser scan optical system 20 is provided which is operative to scan for exposure by a laser beam over the photosensitive drum 10 charged by the charging brush 11. The laser scan optical system 20 is a well-known system incorporating a laser diode, a polygon mirror, and an fθ optical element, and includes a controller to which separate print data in cyan, magenta, yellow, and black colors are transmitted from the host computer. The laser scan optical system 20 sequentially output print data for each respective color in the form of laser beam and scan over the photosensitive drum 10 for exposure, whereby electrostatic latent images in respective colors are sequentially formed on the photosensitive drum 10.

A full-color developing assembly 30 for supplying color toners to the photosensitive drum 10 on which electrostatic latent images are formed in such a way as above mentioned is provided around a support shaft 33 with four separate developing units 31C, 31M, 31Y and 31BK for different colors, i.e., cyan, magenta, yellow and black, in which non-magnetic mono-component toners of cyan, magenta, yellow and black colors are accommodated. The full-color developing assembly 30 is rotatable about the support shaft 33 so that respective developing units 31C, 31M, 31Y and 31BK are guided to a position opposite to the photosensitive drum 10. In respective developing units 31C, 31M, 31Y, and 31BK of the full-color developing assembly 30, toner regulating members 34*a*, 34*b* are held in pressure contact with the outer periphery of a developing sleeve 32, so that the quantity of toner transported by the developing sleeve 32 is regulated by the toner regulating members 34*a*, 34*b*, and so that the toner so transported is caused to be charged.

Each time when an electrostatic latent image of a particular color is formed on the photosensitive drum 10 by the laser scan optical system 20 in manner as mentioned above, the full-color developing assembly 30 is rotated on the support shaft 33 so as to sequentially guide the developing units 31C, 31M, 31Y, 31BK in which are housed corresponding color toners to a position opposite to the photosensitive drum 10. The sleeve 32 in each developing unit 31C, 31M, 31Y, 31BK, is held in contact with the photosensitive drum 10 so that charged toners of respective colors are sequentially supplied onto the photosensitive drum 10 for developing electrostatic latent images of the respective colors formed on the drum 10.

An intermediate transfer endless belt 40 to be driven to rotate as an intermediate transfer member 40 is provided at a location downstream of the full-color developing assembly 30 in the direction of rotation of the photosensitive drum 10. The intermediate transfer belt 40 is designed to be driven to rotate in synchronous relation with the photosensitive drum 10. The intermediate transfer belt 40 is pressed by a rotatable first transfer roller 41 into contact with the photosensitive drum 10. On a portion of a support roller 42 for supporting the intermediate transfer belt 40 there is rotatably mounted a second transfer roller 43 such that a recording sheet S, such as recording paper, is pressed by the second transfer roller 43 against the intermediate transfer belt 40.

A cleaner 50 for scraping any toner residue on the intermediate transfer belt 40 is provided in a space defined between the full-color developing assembly 30 and the intermediate transfer belt 40 so as to be movable toward and away from the intermediate transfer belt 40.

A sheet feeder 60 for guiding recording sheet S, such as recording paper, to the intermediate transfer belt 40 includes a feed tray 61 for accommodating recording sheets S, a roller 62 for feeding recording sheets S housed in the feed tray 61 one by one, and a timing roller 63 for delivering each recording sheet S fed in synchronous relation with an image formed on the intermediate transfer belt 40 into a clearance between the intermediate transfer belt 40 and the second transfer roller 43. Each recording sheets fed between the intermediate transfer belt 40 and the second transfer roller 43 is pressed by the second transfer roller 43 against the intermediate transfer belt 40 which in turn urges the toner image to be transferred onto the recording sheet S.

Each recording sheet S onto which a toner image is press-transferred in manner as described above is guided to a fixing unit 70 by transport means 66 comprising an air suction belt and the like. The toner image transferred at the fixing unit 70 is fixed on a recording sheet S, which is in turn discharged onto the top surface of the apparatus body 1 through a vertical transport path 80.

Operation of the full-color image forming apparatus for formation of full-color images will be explained in detail.

The photosensitive drum 10 and the intermediate transfer belt 40 are driven to rotate at same peripheral velocity in respective directions of rotation so that the photosensitive drum 10 is electrically charged by the charging brush 11 to a specified potential.

A cyan image is exposed by the laser scan optical system 20 to the charged photosensitive drum 10 so as to form an electrostatic latent image of the cyan image on the photosensitive drum 10. Then, cyan toner is provided from the developing unit 31C in which cyan toner is housed to the photosensitive drum 10 for developing the cyan image. The intermediate transfer belt 40 is pressed by the first transfer roller 41 against the photosensitive drum 10 on which a cyan toner image is formed in manner as above mentioned so that the cyan toner image formed on the photosensitive drum 10 is primarily transferred to the intermediate transfer belt 40.

After the cyan toner image is transferred to the intermediate transfer belt 40 in this way, the full-color developing assembly 30 is caused to rotate about the support shaft 33 as earlier mentioned so that the developing unit 31M in which magenta toner is accommodated is guided to a position opposite to the photosensitive drum 10. Then, in the same way as in the case of aforesaid cyan image, a magenta image is exposed to the electrically charged photosensitive drum 10 by the laser scan optical system 20 so as to form an electrostatic latent image. The electrostatic latent image is developed by the developing unit 31M in which magenta toner is housed, and the developed magenta toner image is primarily transferred from the photosensitive drum 10 to the intermediate transfer belt 40. Further, in the same way as above stated, a yellow image and a black image are exposed, developed and primarily transferred in a sequential order. Thus, cyan, magenta, yellow and black toner images are sequentially placed one over another so as to be formed into a full-color toner image.

When a final black toner image is primarily transferred onto the intermediate transfer belt 40, a recording sheet S is fed by the timing roller 63 into the clearance between the second transfer roller 43 and the intermediate transfer belt 40 so as to be pressed by the second transfer roller 43 against the intermediate transfer belt 40 so that the full-color toner image formed on the intermediate transfer belt 40 is secondarily transferred onto the recording sheet S.

After the full-color toner image is secondarily transferred onto recording sheet S in this way, the recording sheet S is conducted by the transport means 66 to the fixing unit 70 in which the transferred full-color toner image is fixed on the recording sheet S. Then, the recording sheet S is discharged through the vertical transport path 80 onto the top surface of the apparatus body 1.

The developing apparatus shown in FIG. 2 is a two-component developing apparatus. This developing apparatus 100 houses therein a developer 101 including toner T and a carrier and comprises a cylindrical developing sleeve 111 rotatably disposed therein as a developer transport member with a magnet roller 110 having plural poles fixedly disposed therein. The developing sleeve 111 is so arranged as to be opposed to an organic photosensitive member 102 across a suitable distance Ds in a developing region.

The developing sleeve 111 is connected to a bias supply 112. The bias supply 112 supplies a developing bias voltage with a DC voltage coupled to an AC voltage. Thereby an oscillating field can be caused to act upon the developing region.

Upstream of the developing region in the direction of developer transport and at a position opposite to magnet pole N1 of the magnet roller 110, there is provided a magnetic blade 113 across a specified distance from the developing sleeve 111 so that the quantity of developing agent on the developing sleeve 111 can be regulated by the magnetic blade 113. Preferable quantity of developing agent is between 0.7 and 10 mg/cm$^2$.

In the developing apparatus 100, a toner housing section 114 for housing toner T is provided on the top of the apparatus so that when the toner concentration in the developer in the developing apparatus 100 drops as a result of development carried out using the toner of the developer from the developing sleeve 111, a toner replenishing roller 115 disposed in a lower portion of the toner housing section 114 is driven to rotate for supply of toner T. The toner so supplied is mixed with the developer under agitation by a mixing-agitating member 116 and the mixture is supplied to the developing sleeve 111.

In the developing apparatus 100, the quantity of developer on the developing sleeve 111 is regulated by the magnetic blade 113 so that the developer is laid in a thin layer form on the developing sleeve 111 and transported to the developing region. A development bias voltage from the development bias supply 112 is applied so that the developing region is subjected to an oscillation field so that the toner in the developer delivered by the developing sleeve 111 is fed from the developing sleeve 111 to the electrostatic latent imaging portion of the photosensitive member 102.

Inorganic Fine Particle Surface Treatment Example 1

Twenty (20) parts by weight of hexamethyl disilazane and 2 parts by weight of octadecyl dimethyl [3-(trimethoxysilyl) propyl] ammonium chloride were dissolved in 500 parts by weight of ethanol. One hundred (100) parts by weight of hydrophilic silica #380 (EH-5, made by Cabot K.K.; specific surface area, 380 m$^2$/g) were mixed with the solution. After the mixture solution was agitated, the ethanol solvent was removed from the mixture by an evaporator. The silica fine particles were dried and disintegrated in a Henschel mixer and then the resulting silica fine particles were heated for drying in an oven at 120° C. for 3 hours. The obtained hydrophobic silica was pulverized (disintegrated). The coarse particles were classified. Thus, hydrophobic silica fine particles (A) were obtained.

Inorganic Fine Particle Surface Treatment Examples 2-7

Hydrophobic silica fine particles (B)–(G) were obtained in the same way as in Treatment Example 1, except that proportions of hexamethyl disilazane (a) and octadecyl dimethyl [3-(trimethoxysilyl) propyl] ammonium chloride (b) were changed as follows:

| | |
|---|---|
| (a)/(b) = 0/2 | silica fine particles (B) |
| (a)/(b) = 10/2 | silica fine particles (C) |
| (a)/(b) = 30/2 | silica fine particles (D) |
| (a)/(b) = 20/0.5 | silica fine particles (E) |
| (a)/(b) = 20/10 | silica fine particles (F) |
| (a)/(b) = 20/0 | silica fine particles (G) |

Inorganic Fine Particle Surface Treatment Example 8

Hydrophobic silica fine particle (H) was obtained in the same way as in Treatment Example 1, except that hydrophilic silica #200 (M-5, made by Cabot K.K.; specific surface area, 200 $m^2/g$) was used as the inorganic fine particle, and that 20 parts by weight of octylsilane and 3 parts by weight of amino-modified silicone oil (KF-857, made by Shin-Etsu Kagaku Kogyo K.K.) were used as the surface treating agent.

Inorganic Fine Particle Surface Treatment Example 9

Hydrophobic silica fine particle (I) was obtained in the same way as in Treatment Example 8, except that 10 parts by weight of γ-(2-aminoethyl)aminopropylmethyl dimethoxysilane was used as the surface treating agent.

Silica fine particles (A)–(I) obtained as above described were examined as to hydrophobicity, blow-off charge, presence of reverse charge component, and particle size distribution. The results are summarized in Table 1-1.

TABLE 1-1

| Silica fine particle | Hydrophobicity | Blow-off charge | Presence of reverse charge component | Particle size distribution: Mean particle size (μm) | Particle size distribution: >30 μm (vol %) |
|---|---|---|---|---|---|
| (A) | 62 | −430 | No | 3.53 | 0 |
| (B) | 32 | −310 | Yes | 3.31 | 0 |
| (C) | 60 | −340 | No | 3.57 | 0 |
| (D) | 65 | −558 | No | 3.37 | 0 |
| (E) | 61 | −684 | No | 3.41 | 0 |
| (F) | 64 | −286 | No | 3.67 | 0 |
| (G) | 58 | −1112 | No | 3.78 | 0 |
| (H) | 58 | −513 | No | 4.18 | 0 |
| (I) | 36 | +212 | No | 4.28 | 0.4 |

In Table 1-1, with respect to "presence of reverse charge component" evaluation was made in such a way that where presence of reverse charge component was recognized in a charging curve obtained during measurement of blow-off charge with respect to inorganic fine particles, that is, where the charging curve contained a reverse charge portion, evaluation was "Yes"; and where presence of reverse charge component was not recognized, evaluation was "No".

Toner Particle Preparation Example 1-1

One hundred (100) parts by weight (the term "part by weight" is hereinafter simply referred to as "part") of a linear polyester resin having no tetrahydrofuran-insoluble component (Mn: 4500, Mw/Mn: 2.3, glass transition point: 60.2° C., softening point: 100.3° C.) which comprises bisphenol A propylene oxide (PO) and bisphenol A ethylene oxide (EO) as alcoholic components, and fumaric acid (FA) and terephthalic acid (TPA) as acid components, 3 parts of phthalocyanine pigment (C. I. pigment blue 15-3), and 1.0 part of a compound expressed by the following structural formula (A-1) as a charge control agent;

(A-1)

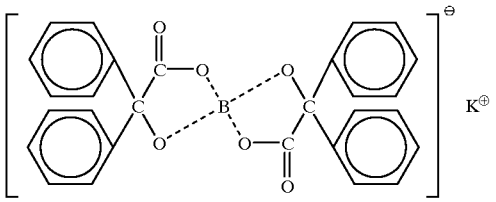

and two parts of a low molecular weight polypropylene wax (Viscol 100TS; made by Sanyo Kasei Kogyo K.K.) were thoroughly mixed in a Henschel mixer. The mixture was melt and kneaded in a twin-screw extruding kneader (PCM-30; made by Ikegai Tekko K.K.). The melt-kneaded mixture was then cooled. The resulting material was rolled by a cooling press roller to a thickness of 2 mm. After having been cooled on a cooling belt, the mixture was roughly pulverized in a feather mill. Then, the roughly pulverized material was pulverized by a mechanical grinder (KTM; made by Kawasaki Jukogyo K. K.) to have a mean particle size of 10 to 12 μm. The pulverized material was further pulverized in a jet crusher (IDS; made by Nippon Pneumatic Kogyo K.K.) to have a mean particle size of 8 μm, with coarse particles separated. Then, fine particle classification was made by a rotor classifier (Teeplex type classifier 100 ATP, made by Hosokawa Micron K.K.). As a result, cyan colored toner particles (A1)-C having a volume-mean particle size of 7.2 μm.

Toner Preparation Example 1-2

Cyan color toner particles (B1)-C were obtained in the same way as in Toner Preparation Example 1-1, except that the following compound B-1 was used in the amount of 1.0 part in place of the compound (A-1).

(B-1)

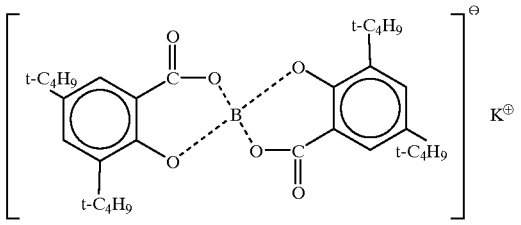

Toner Preparation Example 1-3

Cyan color toner particles (C1)-C were obtained in the same way as in Toner Preparation Example 1-1, except that compound A-1 was not added.

Toner Preparation Example 1-4

Color toner particles, i.e., yellow (A1)-Y, magenta (A1)-M, and black (A1)-B were obtained in the same way as in Toner Preparation Example 1-1, except that the colorants used were 3 parts of C.I. Solvent Yellow 162, 3 parts of C. I. Pigment Red 184, and 5 parts of Carbon Black Mogul L (made by Cabot K.K.).

Toner Preparation Example 1-5

Color toner particles, i.e., yellow (B1)-Y, magenta (B1)-M, and black (B1)-B were obtained in the same way as in Toner Preparation Example 1-2, except that the colorants used were 3 parts of C.I. Solvent Yellow 162, 3 parts of C. I. Pigment Red 184, and 5 parts of Carbon Black Mogul L (made by Cabot K.K.).

Toner Preparation Example 1-6

Color toner particles, i.e., yellow (C1)-Y, magenta (C1)-M, and black (C1)-B were obtained in the same way as in Toner Preparation Example 1-3, except that the colorants used were 3 parts of C.I. Solvent Yellow 162, 3 parts of C. I. Pigment Red 184, and 5 parts of Carbon Black Mogul L (made by Cabot K.K.).

Toner particle size distribution of each toner obtained in the foregoing Preparation Examples is shown in Table 1-2 below.

TABLE 1-2

(Toner Particle Size Distribution)

| Colored toner particle | Vol mean particle size | Vol mean particle size (D) >2 D (%) *1 | Vol mean particle size (D) <⅓D (%) *2 |
|---|---|---|---|
| (A1)-C | 7.2 | 0.1 | 3.2 |
| (A1)-Y | 7.1 | 0 | 3.1 |
| (A1)-M | 7.1 | 0.1 | 3.1 |
| (A1)-B | 7.1 | 0.1 | 3.0 |
| (B1)-C | 7.1 | 0.1 | 3.2 |
| (B1)-Y | 7.1 | 0.1 | 3.2 |
| (B1)-M | 7.0 | 0.1 | 3.1 |
| (B1)-B | 7.0 | 0 | 3.1 |
| (C1)-C | 7.1 | 0.1 | 3.1 |
| (C1)-Y | 7.1 | 0.1 | 3.2 |
| (C1)-M | 7.1 | 0.1 | 3.2 |
| (C1)-B | 7.1 | 0.1 | 3.4 |

(*1: vol %; *2: number %)

Evaluation for Use as Mono-component Developing Agent

Examples 1-1 to 1-6 and Comparative Examples 1-1 to 1-3

Above described toner particles and surface treated silica fine particles were mixed in such combinations and in such proportions as shown in Table 1-3 to give toners. Mixing was carried out in a Henschel mixer at a peripheral speed of 40 m/sec for 90 seconds. A vibrating screen was used to cause particles to pass through mesh openings of 90 $\mu$m.

TABLE 1-3

| Example/ Comp. Example | Silica fine particle Kind | Quantity (parts) | Fog | Transfer-ability | Colored toner particle |
|---|---|---|---|---|---|
| Example 1-1 | A | 0.8 | ○ | ○ | (A1)-C |
| Example 1-2 | C | 0.8 | ○ | ○ | (A1)-C |
| Example 1-3 | D | 0.8 | ○ | ○ | (A1)-C |
| Example 1-4 | E | 0.8 | ○ | ○ | (A1)-C |

TABLE 1-3-continued

| Example/ Comp. Example | Silica fine particle Kind | Quantity (parts) | Fog | Transfer-ability | Colored toner particle |
|---|---|---|---|---|---|
| Example 1-5 | F | 0.8 | ○ | ○ | (A1)-C |
| Example 1-6 | H | 1.0 | ○ | ○ | (A1)-C |
| Comp. Example 1-1 | B | 0.8 | × | × | (A1)-C |
| Comp. Example 1-2 | G | 0.8 | Δ | × | (A1)-C |
| Comp. Example 1-3 | I | 1.0 | × | × | (A1)-C |

Each toner obtained was loaded in a full-color printer of such construction as shown in FIG. 1 (for non-magnetic mono-component development), and evaluation was made with respect to fogging and transferability. Results are shown in Table 1-3.

It is noted that evaluation of fogging and transferability was made in both L/L environment (10° C., 15% RH) and H/H environment (30° C., 85% RH).

(1) Fog evaluation A character pattern of B/W 30% was reproduced on 10 successive sheets. The evaluation of fogging was ranked under a three-grade criterion.

○: Little or no fog was visually recognized in both L/L environment and H/H environment.

Δ: Slight fogging was found in L/L environment or H/H environment, but there was no problem for practical use.

x: Fog was present all over the paper in L/L environment or H/H environment, and there was a problem from the view point of practical use.

(2) Transferability

Transferability evaluation was made under a three-grade criterion according to the quantity of toner deposit on paper relative to the toner deposit on the photosensitive drum.

○: Not less than 90% in both L/L environment and H/H environment.

Δ: Not less than 80% in both L/L environment and H/H environment.

x: Less than 80% in L/L environment or H/H environment.

Examples 1-7 to 1-12 and Comparative Examples 1-4 to 1-6

Toner particle (B1)-C was evaluated in the same way as toner particle (A1)-C. Evaluation results are shown in Table 1-4.

TABLE 1-4

| Example/ Comp. Example | Silica fine particle Kind | Quantity (parts) | Fog | Transfer ability | Colored Toner Particle |
|---|---|---|---|---|---|
| Example 1-7 | A | 0.8 | ○ | ○ | (B1)-C |
| Example 1-8 | C | 0.8 | ○ | ○ | (B1)-C |
| Example 1-9 | D | 0.8 | ○ | ○ | (B1)-C |
| Example 1-10 | E | 0.8 | ○ | ○ | (B1)-C |
| Example 1-11 | F | 0.8 | ○ | ○ | (B1)-C |
| Example 1-12 | H | 1.0 | ○ | ○ | (B1)-C |
| Comp. Example 1-4 | B | 0.8 | × | × | (B1)-C |

TABLE 1-4-continued

| Example/ Comp. Example | Silica fine particle Kind | Quantity (parts) | Fog | Transfer ability | Colored Toner Particle |
|---|---|---|---|---|---|
| Comp. Example 1-5 | G | 0.8 | Δ | × | (B1)-C |
| Comp. Example 1-6 | I | 1.0 | × | × | (B1)-C |

Comparative Examples 1-7 to 1-15

Toner particle (C1)-C was evaluated in the same way as toner particle (A1)-C. Evaluation results are shown in Table 1-5.

TABLE 1-5

| Example Comp. Ex. | Silica fine particle Kind | Quantity (parts) | Fog | Trans Ferability | Colored toner particle |
|---|---|---|---|---|---|
| Comp. Ex. 1-7 | A | 0.8 | × | Δ | (C1)-C |
| Comp. Ex. 1-8 | C | 0.8 | × | Δ | (C1)-C |
| Comp. Ex. 1-9 | D | 0.8 | × | × | (C1)-C |
| Comp. Ex. 1-10 | E | 0.8 | × | × | (C1)-C |
| Comp. Ex. 1-11 | F | 0.8 | × | Δ | (C1)-C |
| Comp. Ex. 1-12 | H | 1.0 | × | × | (C1)-C |
| Comp. Ex. 1-13 | B | 0.8 | × | × | (C1)-C |
| Comp. Ex. 1-14 | G | 0.8 | × | × | (C1)-C |
| Comp. Ex. 1-15 | I | 1.0 | × | × | (C1)-C |

Examples 1-13

Toner particles (A1)-C, (A1)-Y, (A1)-M, and (A1)-B were each mixed with 0.8% by weight of silica fine particles (A). The resulting toner was loaded in a full-color printer of such a construction as shown in FIG. 1. A full-color image having a B/W ratio was reproduced on 3,000 sheets of paper under environmental conditions of 25° C. and 55% RH to evaluate durability with respect to copy.

No image defects occurred. No toner scattering was visually found around aline image. Transferability was not less than 80%.

Evaluation for Use as Two-Component Developer

Preparation of Carrier A

One hundred (100) parts by weight of bisphenol A polyester resin having an acid value of 2 KOHmg/g and a glass transition point Tg of 60° C., 400 parts by weight of magnetic powder (EPT-1000, made by Toda Kogyo K. K.), 5 parts by weight of carbon black having a BET specific surface area of 950 $m^2/g$ and a pH of 9.5 ("Ketchen Black EC", made by Lion Yushi K.K.), and 2 parts by weight of silica having a BET specific surface area of 170 $m^2/g$ (H2000, made by Wacker K.K.) were used in mixture in the preparation of carrier A.

These materials were thoroughly mixed in a Henschel mixer, and the mixture was melt and kneaded at 180° C. in a vented twin-screw kneader. The kneaded mixture, after being cooled, was crushed into coarse particles in a feather mill. The coarse particles were then pulverized in a jet mill (IDS-2 type). Thereafter, the particles were classified by an air classifier, which was followed by heat treatment at 300° C. by a Surfusing System (SFS-1 type; made by Nippon Pneumatic K. K.). As a result, a carrier having a volume-mean particle size of 35 $\mu$m was obtained.

Toners (B1)-C, (B1)-Y, (B1)-M, and (B1)-B were respectively mixed with silica fine particles (A) and hydrophobic titanium dioxide (STT 30-A, made by Chitan Kogyo K.K.) so that the proportion of the silica fine particles was 0.8% by weight and the proportion of the hydrophobic titanium dioxide was 0.8% by weight. Each tonerr was mixed with the carrier A at a toner content of 7% by weight to give a starter. A full-color copying machine CF-900 (made by Minolta K. K.) was remodelled to such a developing device construction as illustrated in FIG. 2. A full-color image B having a B/W ratio of 7% was reproduced on 3,000 sheets of paper under environmental conditions of 25° C. and 55% RH to evaluate durability with respect to copy.

Preset conditions: The distance between the developing sleeve 111 and the magnetic blade 113 was adjusted so that the quantity of developer 1 to be transported by the developing sleeve 111 to the developing region is regulated to 4.5 $mg/cm^2$. The smallest distance between the photosensitive member 102 and developing sleeve was adjusted to 0.35 mm. The peripheral speed of the photosensitive member 102 was adjusted to 165 mm/s. The peripheral speed of the developing sleeve was adjusted to 300 mm/s. The surface potential of that portion of the photosensitive member 102 where toner T was not supplied was set to −450 V and the surface potential of that portion where toner T was supplied was set to −100 V.

In the developing region at which the developing sleeve 111 and the photosensitive member 102 are opposed to each other, a bias voltage from the developing bias supply 112 was applied for reversal development, the bias voltage being such that a DC voltage of −350 V was coupled to an AC voltage having a peak-to-peak value Vp-p of 1.4 kV, a frequency of 3 kHz short wave and a duty ratio of 1:1 (development: collection). The image thus formed was evaluated.

In the evaluation, no or little fog was observed. No or little degradation was observed in image quality.

Toner Particle Preparation Example 2-1

One hundred (100) parts of a linear polyester resin having no tetrahydrofuran-insoluble component (Mn: 4500, Mw/Mn: 2.3, glass transition point: 60.2° C., softening point: 100.3° C.) which comprises bisphenol A propylene oxide (PO) and bisphenol A ethylene oxide (EO) as alcoholic components, and fumaric acid (EA) and terephthalic acid (TPA) as acid components, 3 parts of phthalocyanine pigment (C.I. pigment blue 15-3), and 1.0 part of a compound expressed by the following structural formula (A-2) as a charge control agent;

(A-2)

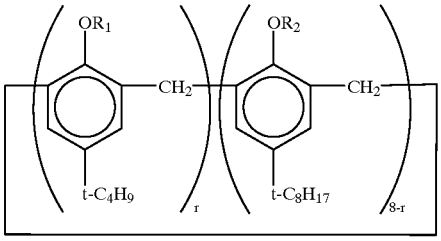

| r | composition ratio (%) | r | composition ratio (%) |
|---|---|---|---|
| 0 | 0.6 | 5 | 22.7 |
| 1 | 1.0 | 6 | 8.1 |
| 2 | 9.9 | 7 | 0.9 |
| 3 | 25.0 | 8 | 0.2 |
| 4 | 31.6 | | |

and two parts low molecular weight polypropylene wax (Viscol 100TS; made by Sanyo Kasei Kogyo K.K.) were thoroughly mixed in a Henschel mixer. The mixture was melt and kneaded in a twin-screw extruding kneader (PVM-30; made by Ikegai Tekko K.K.). The melt-kneaded mixture was then cooled. The resulting material was rolled by a cooling press roller to a thickness of 2 mm. After having been cooled on a cooling belt, the mixture was roughly pulverized in a feather mill. Then, the roughly pulvervized material was pulverized by a mechanical grinder (KTM; made by Kawasaki Jukogyo K. K.) to have a mean particle size of 10 to 1 $\mu$m. The pulverized material was further pulverized in a jet crusher (IDS; made by Nippon Pneumatic Kogyo K.K.) to have a mean particle size of 8 $\mu$m, with coarse particles separated. Then, fine particle classification was made by a rotor classifier (Teeplex type classifier 100 ATP, made by Hosokawa Micron K.K.). As a result, cyan colored toner particles (A2)-C having a volume-mean particle size of 7.2 $\mu$m Toner Preparation Example 2-2

Cyan color toner particles (B2)-C were obtained in the same way as in Toner Preparation Example 2-1, except that the following compound B-2 was used in the amount of 1.0 part in place of the compound (A-2)

(B-2)

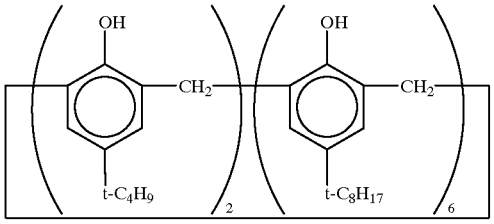

Toner Preparation Example 2-3

Cyan color toner particles (C2)-C were obtained in the same way as in Toner Preparation Example 2-1, except that compound A-2 was not added.

Toner Preparation Example 2-4

Color toner particles, i.e., yellow (A2)-Y, magenta (A2)-M, and black (A2)-B were obtained in the same way as in Toner Preparation Example 1-1, except that the colorants used were 3 parts of C.I. Solvent Yellow 162, 3 parts of C. I. Pigment Red 184, and 5 parts of Carbon Black Mogul L (made by Cabot K.K.).

Toner Preparation Example 2-5

Color toner particles, i.e., yellow (B2)-Y, magenta (B2)-M, and black (B2)-B were obtained in the same way as in Toner Preparation Example 2-2, except that the colorants used were 3 parts of C.I. Solvent Yellow 162, 3 parts of C. I. Pigment Red 184, and 5 parts of Carbon Black Mogul L (made by Cabot K.K.).

Toner Preparation Example 2-6

Color toner particles, i.e., yellow (C2)-Y, magenta (C2)-M, and black (C2)-B were obtained in the same way as in Toner Preparation Example 2-3, except that the colorants used were 3 parts of C.I. Solvent Yellow 162, 3 parts of C. I. Pigment Red 184, and 5 parts of Carbon Black Mogul L (made by Cabot K.K.).

Toner particle size distribution of each toner obtained in the foregoing Preparation Examples is shown in Table 2-1 below.

TABLE 2-1

(Toner Particle Size Distribution)

| Colored toner particle | Vol mean particle size | Vol mean particle size (D) >2 D (%) *1 | Vol mean particle size (D) <½D (%) *2 |
|---|---|---|---|
| (A2)-C | 7.0 | 0.1 | 3.5 |
| (A2)-Y | 6.9 | 0.1 | 3.4 |
| (A2)-M | 7.0 | 0.1 | 3.4 |
| (A2)-B | 7.0 | 0.1 | 3.0 |
| (B2)-C | 7.1 | 0.1 | 3.2 |
| (B2)-Y | 6.9 | 0.1 | 3.3 |
| (B2)-M | 6.9 | 0.1 | 3.1 |
| (B2)-B | 7.1 | 0 | 3.4 |
| (C2)-C | 7.0 | 0.1 | 3.1 |
| (C2)-Y | 6.9 | 0.1 | 3.5 |
| (C2)-M | 6.8 | 0.1 | 3.2 |
| (C2)-B | 6.9 | 0.1 | 3.2 |

(*1: vol %; *2: number %)

Evaluation for Use as Mono-component Developing Agent

Examples 2-1 to 2-6 and Comparative Examples 2-1 to 2-3

Above described toner particles and surface treated silica fine particles were mixed in such combinations and in such proportions as shown in Table 2-2 to give toners. Mixing was carried out in a Henschel mixer at a peripheral speed of 40 m/sec for 90 seconds. A vibrating screen was used to cause particles to pass through mesh openings of 90 $\mu$m.

TABLE 2-2

| Example/ Comp. Example | Silica fine particle Kind | Quantity (parts) | Fog | Transfer-ability | Colored toner particle |
|---|---|---|---|---|---|
| Example 2-1 | A | 0.8 | ○ | ○ | (A2)-C |
| Example 2-2 | C | 0.8 | ○ | ○ | (A2)-C |
| Example 2-3 | D | 0.8 | ○ | ○ | (A2)-C |
| Example 2-4 | E | 0.8 | ○ | ○ | (A2)-C |

TABLE 2-2-continued

| Example/ Comp. Example | Silica fine particle Kind | Quantity (parts) | Fog | Transfer-ability | Colored toner particle |
|---|---|---|---|---|---|
| Example 2-5 | F | 0.8 | ○ | ○ | (A2)-C |
| Example 2-6 | H | 1.0 | ○ | ○ | (A2)-C |
| Comp. Example 2-1 | B | 0.8 | × | × | (A2)-C |
| Comp. Example 2-2 | G | 0.8 | Δ | × | (A2)-C |
| Comp. Example 2-3 | I | 1.0 | × | × | (A2)-C |

Each toner obtained was loaded in a full-color printer of such construction as shown in FIG. 1 (for non-magnetic mono-component development), and evaluation was made with respect to fogging and transferability. Results are shown in Table 2-2. The evaluation of fogging and transferability was made in the same was as above mentioned.

Examples 2-7 to 2-12 and Comparative Examples 2-4 to 2-6

Toner particle (B2)-C was evaluated in the same way as toner particle (A2)-C. Evaluation results are shown in Table 2-3.

TABLE 2-3

| Example/ Comp. Example | Silica fine particle Kind | Quantity (parts) | Fog | Transfer ability | Colored Toner particle |
|---|---|---|---|---|---|
| Example 2-7 | A | 0.8 | ○ | ○ | (B2)-C |
| Example 2-8 | C | 0.8 | ○ | ○ | (B2)-C |
| Example 2-9 | D | 0.8 | ○ | ○ | (B2)-C |
| Example 2-10 | E | 0.8 | ○ | ○ | (B2)-C |
| Example 2-11 | F | 0.8 | ○ | ○ | (B2)-C |
| Example 2-12 | H | 1.0 | ○ | ○ | (B2)-C |
| Comp. Example 2-4 | B | 0.8 | × | × | (B2)-C |
| Comp. Example 2-5 | G | 0.8 | Δ | × | (B2)-C |
| Comp. Example 2-6 | I | 1.0 | × | × | (B2)-C |

Comparative Examples 2-7 to 2-15

Toner particle (C2)-C was evaluated in the same way as toner particle (A2)-C. Evaluation results are shown in Table 2-4.

TABLE 2-4

| Example Comp. Ex. | Silica fine particle Kind | Quantity (parts) | Fog | Trans Ferability | Colored toner particle |
|---|---|---|---|---|---|
| Comp. Ex. 2-7 | A | 0.8 | × | Δ | (C2)-C |
| Comp. Ex. 2-8 | C | 0.8 | × | Δ | (C2)-C |
| Comp. Ex. 2-9 | D | 0.8 | × | × | (C2)-C |
| Comp. Ex. 2-10 | E | 0.8 | × | × | (C2)-C |
| Comp. Ex. 2-11 | F | 0.8 | × | Δ | (C2)-C |

TABLE 2-4-continued

| Example Comp. Ex. | Silica fine particle Kind | Quantity (parts) | Fog | Trans Ferability | Colored toner particle |
|---|---|---|---|---|---|
| Comp. Ex. 2-12 | H | 1.0 | × | × | (C2)-C |
| Comp. Ex. 2-13 | B | 0.8 | × | × | (C2)-C |
| Comp. Ex. 2-14 | G | 0.8 | × | × | (C2)-C |
| Comp. Ex. 2-15 | I | 1.0 | × | × | (C2)-C |

Examples 2-13

Toner particles (A2)-C, (A2)-Y, (A2)-M, and (A2)-B were each mixed with 0.8% by weight of silica fine particles(A). The resulting toner was loaded in a full-color printer of such a construction as shown in FIG. 1. A full-color image having a B/W ratio was reproduced on 3,000 sheets of paper under environmental conditions of 25° C. and 55% RH to evaluate durability with respect to copy.

No image defects occurred. No toner scattering was visually found around a line image. Transferability was not less than 80%.

Evaluation for Use as Two-Component Developer

Toners (B2)-C, (B2)-Y, (B2)-M, and (B2)-B were respectively mixed with silica fine particles (A) and hydrophobic titanium dioxide (STT 30-A, made by Chitan Kogyo K.K.) so that the proportion of the silica fine particles was 0.8% by weight and the proportion of the hydrophobic titanium dioxide was 0.8% by weight. Each toner was mixed with the carrier A at a toner content of 7% by weight to give a starter. A full-color copying machine CF-900 (made by Minolta K.K.) was remodelled to such a developing device construction as illustrated in FIG. 2. A full-color image B having a B/W ratio of 7% was reproduced on 3,000 sheets of paper under environmental conditions of 25° C. and 55% RH to evaluate durability with respect to copy. Preset conditions were the same as above described.

In the evaluation, no or little fog was observed. No or little degradation was observed in image quality.

The present invention provides a negatively chargeable toner excellent in rapid charge rise, transferability, constant charge retentivity and environmental stability. The toner of the present invention can reproduce excellent images free of toner fogs, image defects or toner scattering.

What is claimed is:

1. A negatively chargeable toner, comprising:

fine toner particles which contain a binder resin, a colorant, and a calix arene compound represented by the following general formula (III):

(III)

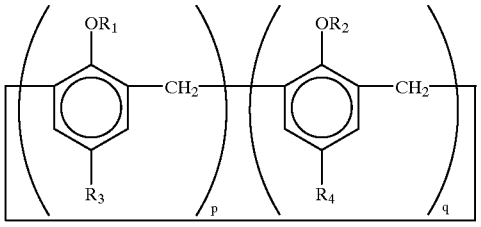

in which, $R_1$ and $R_2$ respectively represent a hydrogen atom and an alkyl group having 1 to 5 carbon atoms or —$(CH_2)_xCOOR_5$ group ($R_5$ represents a hydrogen atom or a lower alkyl group; x represents an integer of 1–3); $R_3$ and $R_4$ each represent a hydrogen atom, a halogen atom, an alkyl group having 1 to 12 carbon atoms which may be branched or aryl group; p represents an integer of 4 to 8; q represents an integer of 0 to 4; and p+q is 4 to 8); and inorganic fine particles which are treated with a hydrophobicizing agent and a surface treating agent having an amino group or an ammonium salt group, the inorganic fine particles being externally added to the toner particles and having a blow-off charge quantity (Q) of $-800<Q<-200$ $\mu$C/g relative to iron oxide particles, an amount of the hydrophobicizing agent being 20 to 50 parts by weight relative to 100 parts by weight of the inorganic fine particles, an amount of the surface treating agent being 0.5 to 20 parts by weight relative to 100 parts by weight of the inorganic fine particles, the hydrophobicizing agent selected from the group consisting of a silane coupling agent and a silicone oil, the silane coupling agent selected from the group consisting of chlorosilane, alkylsilane, alkoxysilane and silazane.

2. A negatively chargeable toner of claim 1, in which the calix arene compound is represented by the following chemical formula (IV);

(IV)

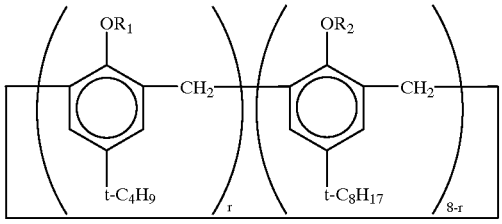

in which $R_1$ and $R_2$ respectively represent a hydrogen atom and an alkyl group having 1 to 5 carbon atoms or —$(CH_2)$ $xCOOR_5$ group ($R_5$ represents a hydrogen atom or a lower alkyl group; x represents an integer of 1–3); and r denotes an integer of 1 to 7.

3. A negatively chargeable toner of claim 1, in which the calix arene compound is a mixture of two or more kind of compounds represented by the following chemical formula (IV) but having different numbers for r;

(IV)

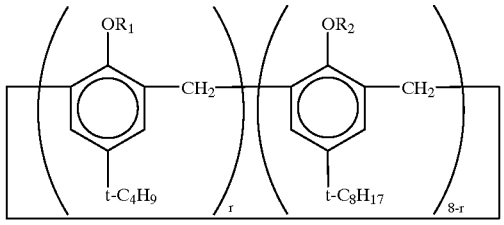

in which $R_1$ and $R_2$ respectively represent a hydrogen atom and an alkyl group having 1 to 5 carbon atoms or —$(CH_2)_xCOOR_5$ group ($R_5$ represents a hydrogen atom or a lower alkyl group; x represents an integer of 1–3); and r denotes an integer of 0 to 8.

4. A negatively chargeable toner of claim 1, in which the surface treating agent is a silane coupling agent having an amino group or an ammonium salt group or a silicone oil having an amino group or an ammonium salt group.

5. A negatively chargeable toner of claim 1, in which the hydrophobicity of the inorganic fine particles is 30% or more.

6. A negatively chargeable toner of claim 1, in which the hydrophobicity of the inorganic fine particles is 50% or more, and the blow-off charge quantity (Q) is $-700<Q<-200$ $\mu$C/g.

7. A negatively chargeable toner of claim 1, in which the inorganic fine particles have a mean primary particle size of 0.001 to 5 $\mu$m.

8. A negatively chargeable toner of claim 1, in which the inorganic fine particles treated with the hydrophobicizing agent and with the surface treating agent having a cationic group have a volume-mean particle size of not more than 10 $\mu$m measured according to a laser diffraction dry method and contain not more than 1% by volume of particles having a particle size of 30 $\mu$m or more.

9. A negatively chargeable toner of claim 1, in which the toner particles have a volume mean particle size of 2 to 9 $\mu$m, and include not more than 2% by weight of particles having not less than two times the volume mean particle size, and not more than 5% by number of particles having a particle size of not more than one third of the volume mean particle size.

10. The negatively chargeable toner of claim 1, wherein the surface treating agent is in an amount of 2 to 20 parts by weight relative to 100 parts by weight of the inorganic fine particles.

11. A negatively chargeable toner, comprising:

fine toner particles which contain a binder resin, a colorant, and a compound selected from the group consisting of the following general formulas (I) and (II):

(I)

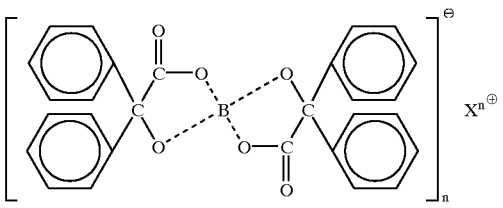

-continued (II)

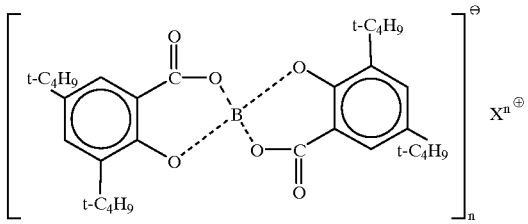

in which X represents cation, and n represents an integer of 1 or 2; and inorganic fine particles which are treated with a hydrophobicizing agent and a surface treating agent having an amino group or an ammonium salt group, the inorganic fine particles being externally added to the toner particles and having a blow-off charge quantity (Q) of $-800<Q<-200$ $\mu$C/g relative to iron oxide particles, an amount of the hydrophobicizing agent being 20 to 50 parts by weight relative to 100 parts by weight of the inorganic fine particles, an amount of the surface treating agent being 0.5 to 20 parts by weight relative to 100 parts by weight of the inorganic fine particles, the hydrophobicizing agent selected from the group consisting of a silane coupling agent and a silicone oil, the silane coupling agent selected from the group consisting of chlorosilane, alkylsilane, alkoxysilane and silazane.

12. A negatively chargeable toner of claim 11, in which X is selected from the group consisting of alkali metal ions, alkali earth metal ions, ammonium ions, iminium ions, phosphonium ions and hydrogen ion.

13. A negatively chargeable toner of claim 11, in which the surface treating agent is a silane coupling agent having an amino group or an ammonium salt group or a silicone oil having an amino group or an ammonium salt group.

14. A negatively chargeable toner of claim 11, in which the hydrophobicity of the inorganic fine particles is 30% or more.

15. A negatively chargeable toner of claim 11, in which the hydrophobicity of the inorganic fine particles is 50% or more, and the blow-off charge quantity (Q) is $-700<Q<-200$ $\mu$C/g.

16. A negatively chargeable toner of claim 11, in which the inorganic fine particles have a mean primary particle size of 0.001 to 5 $\mu$m.

17. A negatively chargeable toner of claim 11, in which the inorganic fine particles treated with the hydrophobicizing agent and with the surface treating agent having a cationic group have a volume-mean particle size of not more than 10 $\mu$m measured according to a laser diffraction dry method and contain not more than 1% by volume of particles having a particle size of 30 $\mu$m or more.

18. A negatively chargeable toner of claim 11, in which the toner particles have a volume mean particle size of 2 to 9 $\mu$m, and include not more than 2% by weight of particles having not less than two times the volume mean particle size, and not more than 5% by number of particles having a particle size of not more than one third of the volume mean particle size.

19. A negatively chargeable toner of claim 11, in which the inorganic fine particles are silica fine particles.

20. The negatively chargeable toner of claim 11, wherein the surface treating agent is in an amount of 2 to 20 parts by weight relative to 100 parts by weight of the inorganic fine particles.

21. A developing apparatus, comprising;

a developer-supporting member having a surface which is movable and whereon developer is kept;

a developer-regulating member which contacts the developer-supporting member and forms a thin layer of developer on the developer-supporting member;

a voltage-supplying device for applying a bias voltage to the developer-supporting member;

a developer container; and a negatively chargeable mono-component developer contained in the container, comprising:

fine toner particles which contain a binder resin, a colorant, and a compound selected from the group consisting of the following general formulas (I), (II) and (III); and inorganic fine particles which are treated with a hydrophobicizer and a surface treating agent having an amino group or an ammonium salt group, and which have a blow-off charge quantity (Q) of $-800<Q<-200$ $\mu$C/g relative to iron oxide particles, the inorganic fme particles being admixed externally to the toner particles, an amount of the hydrophobicizing agent being 20 to 50 parts by weight relative to 100 parts by weight of the inorganic fine particles, an amount of the surface treating agent being 0.5 to 20 parts by weight relative to 100 parts by weight of the inorganic fine particles, the hydrophobicizing agent selected from the group consisting of a silane coupling agent and a silicone oil, the silane coupling agent selected from the group consisting of chlorosilane, alkylsilane, alkoxysilane and silazane;

wherein general formulas (I), (II) and (III) are as follows:

(I)

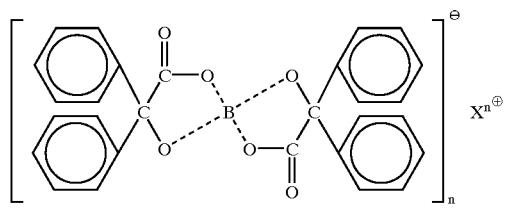

-continued (II)

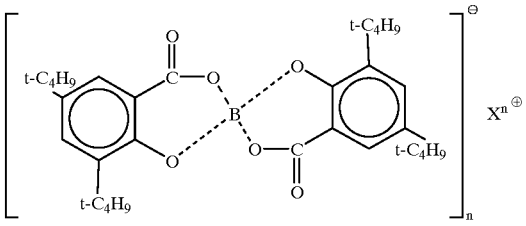

(III)

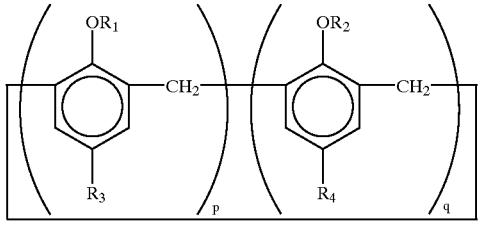

in which X represents cation, and n represents an integer of 1 or 2, $R_1$ and $R_2$ respectively represent a hydrogen atom and an alkyl group having 1 to 5 carbon atoms or —$(CH_2)_xCOOR_5$ group ($R_5$ represents a hydrogen atom or a lower alkyl group; x represents an integer of 1–3); $R_3$ and $R_4$ each represent a hydrogen atom, a halogen atom, an alkyl group having 1 to 12 carbon atoms which may be branched or aryl group; p represents an integer of 4 to 8; q represents an integer of 0 to 4; and p+q is 4 to 8.

22. A developing apparatus of claim 21, in which the surface treating agent is a silane coupling agent having an amino group or an ammonium salt group, or a silicone oil having an amino group or an ammonium salt group.

23. A developing apparatus of claim 21, in which the hydrophobicity of the inorganic fine particles is 50% or more, and the blow-off charge quantity (Q) is $-700<Q<-200$ $\mu$C/g.

24. A developing apparatus of claim 21, in which the inorganic fine particles are silica fine particles.

25. The developing apparatus of claim 21, wherein the surface treating agent is in an amount of 2 to 20 parts by weight relative to 100 parts by weight of the inorganic fine particles.

26. A developing apparatus, comprising;

a developer-supporting member having a surface which is movable and a magnetic member being arranged therein fixedly;

a developer-regulating member which opposes the developer-supporting member across a space so that a regulated amount of a two component developer is fed to the developer-supporting member;

a voltage-supplying device for applying a bias voltage to the developer-supporting member with an alternating current voltage coupled with a direct current voltage;

developer container; and two-component developer contained in the container, comprising:

negatively chargeable fine toner particles which contain a binder resin, a colorant, and a compound selected from the group consisting of the following general formulas (I), (II) and (III);

inorganic fine particles which are treated with a hydrophobicizer and a surface treating agent having an amino group or an ammonium salt group, and which have a blow-off charge quantity (Q) of $-800<Q<-200$ $\mu$C/g relative to iron oxide particles, the inorganic fine particles being admixed externally to the toner particles, an amount of the hydrophobicizing agent being 20 to 50 parts by weight relative to 100 parts by weight of the inorganic fine particles, an amount of the surface treating agent being 0.5 to 20 parts by weight relative to 100 parts by weight of the inorganic fine particles, the hydrophobicizing agent selected from the group consisting of a silane coupling agent and a silicone oil, the silane coupling agent selected from the group consisting of chlorosilane, alkylsilane, alkoxysilane and silazane; and magnetic carrier particles;

wherein general formulas (I), (II) and (III) are as follows:

(I)

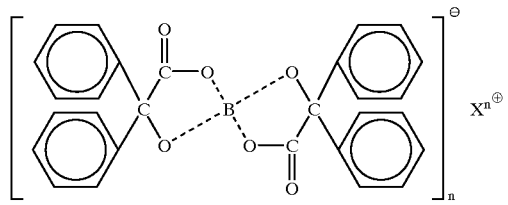

(II)

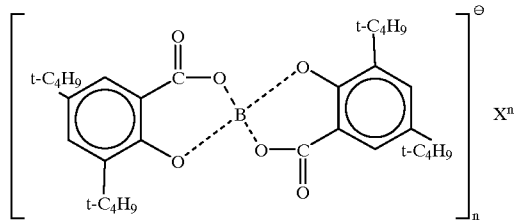

(III)

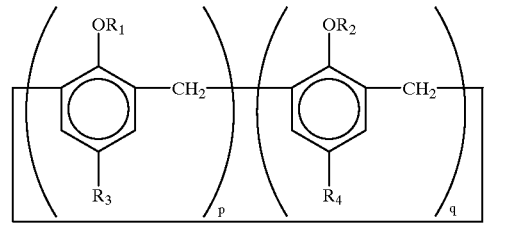

in which X represents cation, and n represents an integer of 1 or 2, $R_1$ and $R_2$ respectively represent a hydrogen atom and an alkyl group having 1 to 5 carbon atoms or —$(CH_2)_xCOOR_5$ group ($R_5$ represents a hydrogen atom or a lower alkyl group; x represents an integer of 1–3); $R_3$ and $R_4$ each represent a hydrogen atom, a halogen atom, an alkyl group having 1 to 12 carbon atoms which may be branched or aryl group; p represents an integer of 4 to 8; q represents an integer of 0 to 4; and p+q is 4 to 8.

27. A developing apparatus of claim 26, in which the regulated amount of the two component developer is 0.7 to 10 mg/cm$^2$.

28. A developing apparatus of claim 26, in which the surface treating agent is a silane coupling agent having an amino group or an ammonium salt group, or a silicone oil having an amino group or an ammonium salt group.

29. A developing apparatus of claim 26, in which the hydrophobicity of the inorganic fine particles is 50% or more, and the blow-off charge quantity (Q) is $-700<Q<-200$ $\mu$C/g.

30. A developing apparatus of claim 26, in which the inorganic fine particles are silica fine particles.

31. The developing apparatus of claim 26, wherein the surface treating agent is in an amount of 2 to 20 parts by weight relative to 100 parts by weight of the inorganic fine particles.

* * * * *